US006241330B1

(12) United States Patent
Lye et al.

(10) Patent No.: US 6,241,330 B1
(45) Date of Patent: Jun. 5, 2001

(54) KITCHEN WORKSTATION INCORPORATING DUAL DIRECTION SLIDING TRAY

(75) Inventors: Michael T. Lye, Warwick, RI (US); John P. Flannery, Smith (BM); Marc S. Harrison, deceased, late of Portmouth, RI (US), by Diana Harrison, legal representative; George G. Brin, Jr., Providence, RI (US); Luke N. Michas, North Providence, RI (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/440,121

(22) Filed: Nov. 15, 1999

(51) Int. Cl.[7] ..... A47B 96/18

(52) U.S. Cl. ..... 312/140.4; 312/228; 312/312; 312/310

(58) Field of Search ..... 312/196, 140.1, 312/140.4, 140.3, 310, 236, 237, 286, 287, 306, 312, 228.1, 228

(56) References Cited

U.S. PATENT DOCUMENTS

| | | | | |
|---|---|---|---|---|
| 1,896,648 | | 2/1933 | Thomas . | |
| 2,550,539 | | 4/1951 | Earle . | |
| 2,575,725 | * | 11/1951 | McKay | 312/312 |
| 2,627,445 | * | 2/1953 | Lyon | 312/312 X |
| 2,750,611 | | 6/1956 | Chatel . | |
| 2,894,604 | * | 7/1959 | McMillan | 312/236 X |
| 2,947,311 | | 8/1960 | Fox et al. . | |
| 3,075,215 | | 1/1963 | Marue . | |
| 3,207,167 | | 9/1965 | Edstrom . | |
| 3,378,325 | | 4/1968 | Mayer . | |
| 3,582,173 | | 6/1971 | Noren . | |
| 3,650,591 | * | 3/1972 | Longmire, Sr. | 312/312 |
| 3,794,400 | | 2/1974 | Guth . | |
| 3,983,583 | * | 10/1976 | Herman et al. | 312/228 X |
| 3,997,028 | * | 12/1976 | Lopez | 312/306 X |
| 4,073,555 | | 2/1978 | Noren . | |
| 4,739,781 | | 4/1988 | Casoli . | |
| 4,811,997 | | 3/1989 | Suyama et al. . | |
| 5,687,752 | | 11/1997 | Boylan . | |

FOREIGN PATENT DOCUMENTS

| | | | | |
|---|---|---|---|---|
| 17402 | * | 8/1906 | (GB) | 312/312 |

* cited by examiner

*Primary Examiner*—Janet M. Wilkens
(74) *Attorney, Agent, or Firm*—Everett G. Diederiks, Jr.

(57) ABSTRACT

An article support and transfer assembly includes a carrier frame, which is selectively shiftable between raised and lowered positions relative to a countertop work surface, and an article support tray which is mounted for sliding movement in opposing directions between a first extended position, wherein the article support tray projects, at least partially, over the work surface and, a second extended position, wherein the tray projects over a side edge portion of the countertop. The tray can be shifted between the first and second extended positions for loading and unloading thereof and arranged in an intermediate position wherein the tray can be lowered with the carrier frame into a base associated with the countertop.

19 Claims, 2 Drawing Sheets

KITCHEN WORKSTATION INCORPORATING DUAL DIRECTION SLIDING TRAY

BACKGROUND OF THE INVENTION

1. Field of the Invention

The present invention concerns a kitchen environment and, more specifically, is directed to a kitchen workstation incorporating a dual direction sliding tray.

2. Discussion of the Prior Art

Whenever preparing for or serving a meal to be eaten outside an area of a kitchen, it is often necessary to make numerous trips back and forth to the kitchen in order to obtain the necessary dinnerware, utensils, food items, condiments and the like. If the kitchen is of limited size or only has a single convenient entrance, the necessary trips can become cumbersome and time consuming. Even if the kitchen is more open, such as in a design including an island or a through opening provided in one or more walls, there is still a fair amount of maneuvering required about the island and walls which prolongate the meal preparation time. Even in arrangements wherein there is a table, attached to or directly adjacent the island on the opposite side of the kitchen area, which can be used in connection with chairs or the like as a small breakfast or other eating space, it can still be difficult to access items from the kitchen portion of the island from the eating area.

A similar potential problem exists following a meal. That is, all of the used plates, containers and utensils generally need to be hand-carried back to the kitchen area for cleaning, left-over food needs to be properly cared for and the various condiments need to be returned to the kitchen area. Although hand trays could be utilized to collect many of these items to limit the number of necessary trips, there still exists a need in the art for a system which will enable a wide range of items to be readily transferred back and forth between a kitchen area and an adjacent eating area in a convenient manner in order to effectively reduce meal preparation and clean up times.

SUMMARY OF THE INVENTION

The present invention pertains to a kitchen workstation, such as an island, that includes a countertop defining a work space, along with an article support member that is slidably mounted for movement in opposing directions relative to the countertop. More specifically, the article support member is adapted to be shiftable to a first extended position, wherein the support member projects above at least a portion of the work space of the countertop, and a second extended position, wherein the article support member is shifted away from the kitchen to preferably beyond a side edge of the countertop which is exposed to an eating area adjacent to the kitchen.

In the most preferred form of the invention, the kitchen workstation is defined by an island having a platform extending over a portion of the countertop such that the work space is defined on one side of the platform and the other side of the platform is remote from the kitchen. The article support member is generally constituted by a tray that can be shifted in either one of opposing directions from a central location over the platform. The tray is slidably mounted through rails that guide the tray for movement between the first and second extended positions. The rails are arranged as sets, with one rail of each set being fixed to the tray and another rail of the set being fixed to a carrier frame. In the most preferred form of the invention, the carrier frame can also be repositioned vertically relative to the countertop in order to arrange the tray in either an exposed or recessed condition.

Additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
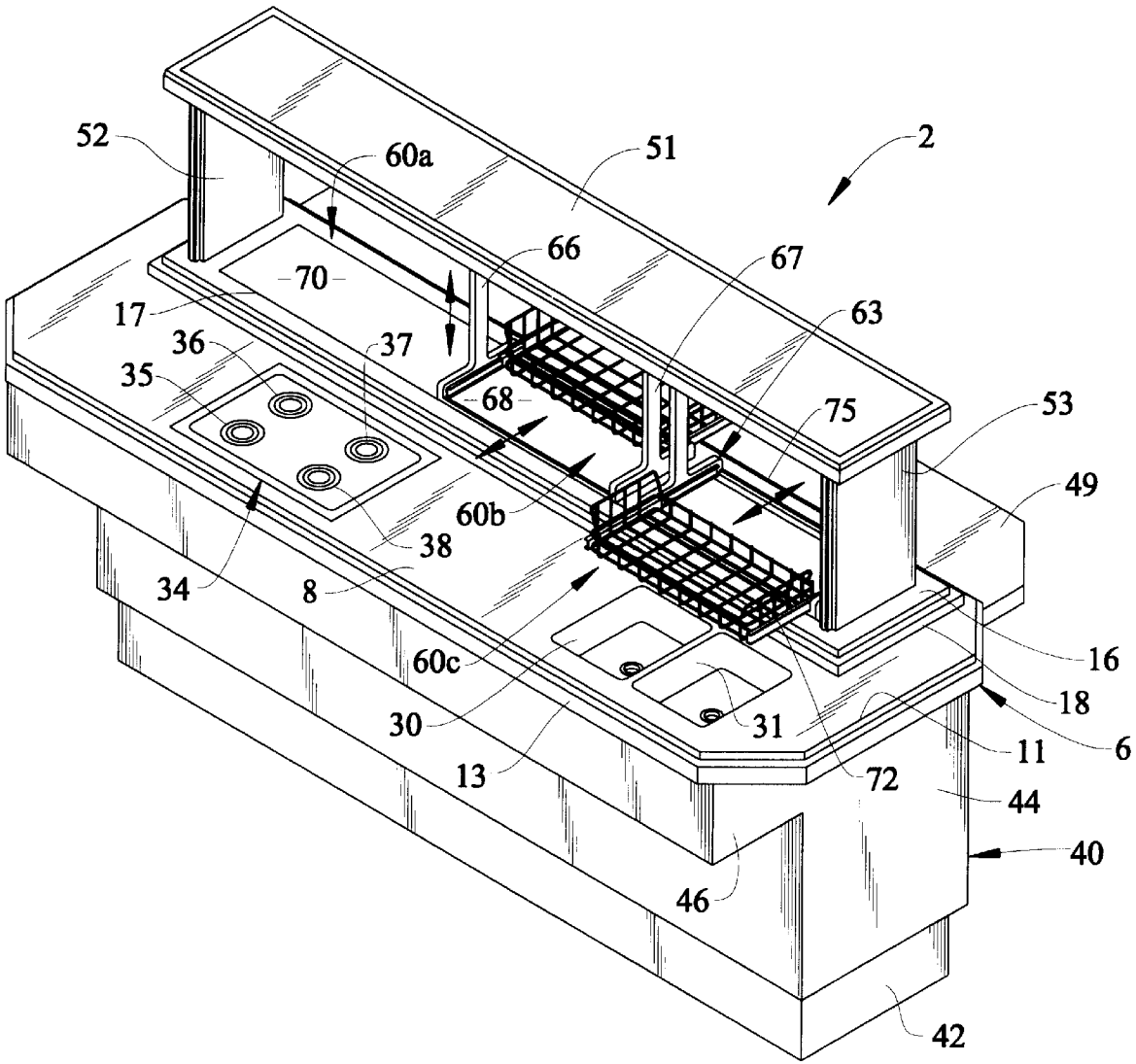
FIG. 1 is an upper perspective view of a kitchen island including a plurality of dual direction sliding trays in accordance with the invention.

With initial reference to FIG. 1, a workstation for a cooking environment that is generally illustrated to take the form of a kitchen island is indicated at 2. Island 2 includes an overall countertop 6 having a work surface 8 that is preferably provided with a peripheral lip 11. Also located around first work surface 8, at a position slightly outwardly and below lip 11, is railing trim 13. As shown, countertop 6 also includes a raised platform 16 having a central zone 17 and an associated, intermediate tier 18. In the embodiment shown, island 2 is provided with a pair of spaced sinks 30 and 31, as well as a cooking appliance shown in the form of an electric cooktop 34. For the sake of simplicity of the drawings, a faucet for sinks 30 and 31, as well as controls for cooktop 34 have not been illustrated. However, cooktop 34 is shown to include multiple, spaced heating elements 35–38. Although the structure and arrangement of cooktop 34 is not considered part of the present invention, cooktop 34 preferably defines a substantially smooth working surface across countertop 6.

Countertop 6 is shown to be supported by a base 40 having a lowermost section 42 and an upper section 44 that includes an outwardly extending portion 46. Therefore, upper section 44, with outwardly extending portion 46, supports countertop 6 such that first work surface 8 extends in a substantially horizontal plane. At this point, it should be noted that outwardly extending portion 46 need not extend entirely across the longitudinal side of countertop 6 but could simply be constituted by various spaced, cantilevered beams if enhanced leg room or the like is desirable under countertop 6. In any event, upper section 44 of base 40 is further used to support a table 49 that is adapted to be used in connection with chairs or the like as a small breakfast or other eating area while the portion of countertop 6 located on the opposite side of platform 16 from table 49 would generally be located in the kitchen area. Again, this arrangement is merely presented in accordance with the preferred embodiment of the invention and for the sake of completeness. For the same reason, island 2 is shown to include an upper tabletop 51 that is spaced above platform 16 by means of pillars 52 and 53.

The present invention is particularly directed to the incorporation of one or more article support and transfer assemblies, as indicated at 60*a*, 60*b* and 60*c*, incorporated into island 2. In general, the construction of each assembly 60*a*, 60*b*, 60*c* is identical such that only a single description of the various assemblies 60*a*–60*c* will be presented here and it is to be understood that this description is applicable to all of the assemblies. With reference to both FIGS. 1 and 2, each assembly 60*a*–60*c* includes a carrier frame 63 that is preferably formed from a pair of spaced, inverted. T- or I-shaped supports 66 and 67 which are interconnected at lower ends thereof by a base 68 and at an upper end by a cover or top 70. Located between the supports 66 and 67 of each carrier frame 63 is a respective article support tray 72. In the preferred embodiment shown, support tray 72 is constituted by a wire rack. However, tray 72 can be constituted by various different types of support members, including a planar board made of wood, plastic or the like. In general, when considering the structure of tray 72, it is only important that tray 72 can support articles to be transferred on either side of tabletop 51 as will become more fully evident below.

Each article support tray 72 is slidably mounted for movement relative to carrier frame 63 and countertop 6 in opposing directions. More specifically, each tray 72 can shift between a first extended position, wherein tray 72 projects above at least a portion of work surface 8 as represented with the tray 72 provided on the far right side in FIGS. 1 and 2, and an opposing, second extended position, wherein tray 72 projects, at least partially, beyond a side edge 75 of countertop 6 as shown in connection with the tray 72 arranged in the central portion of platform 16.

More specifically, each tray 72 is interconnected to supports 66, 67 through a respective set of rail members generally indicated at 77. Each set of rail members 77 includes a rail member 79 which is fixedly secured to a respective support 66, 67 and a second rail member 80 which is fixed along a respective side portion of tray 72 as clearly shown in these Figures. In general, each set of rail members 77 is constructed in a manner generally known in the art such that the construction of these rail members do not form a particular aspect of the present invention. Instead, what is important to note is that each tray 72 can slide from a central position above zone 17 in a first direction towards the kitchen and work surface 8, or in a second, opposing direction towards an eating area, such as table 49. With this arrangement, tray 72 can be positioned over work surface 8 wherein food and other articles can be loaded onto tray 72 and then tray 72 can be slid to a position extending over side edge 75 of countertop 6 wherein the articles within tray 72 can be easily accessed from the side of island 2 at table 49. At the end of a meal, dirty dishes, left-over food and the like can be conveniently placed in tray 72 adjacent table 49 and then slid back into the kitchen area for unloading.

Figure 2:
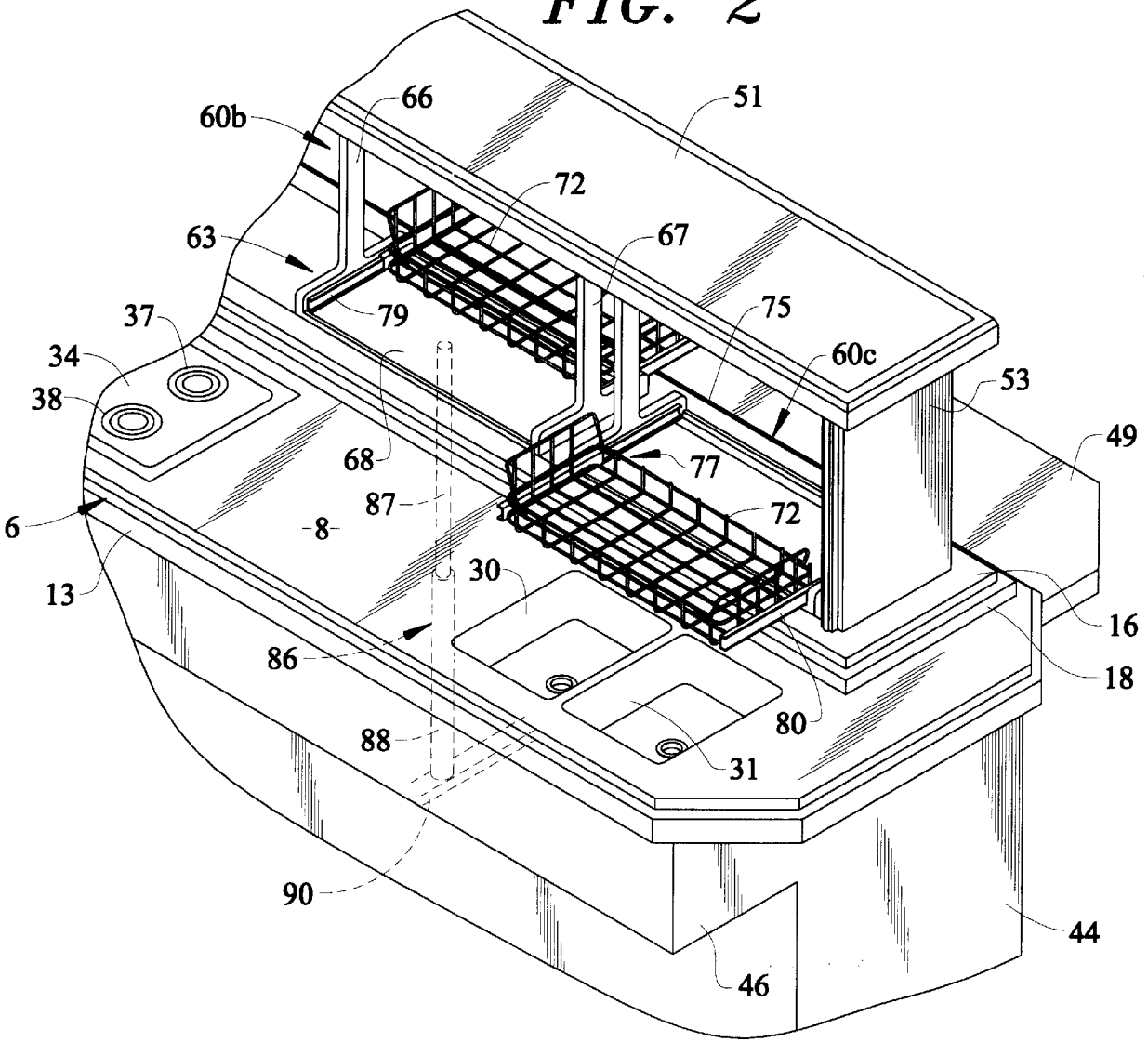
FIG. 2 is an enlarged perspective view of a section of the kitchen workstation of FIG. 1.

In accordance with the most preferred form of the invention, carrier frame 63 is also preferably mounted for vertical movement relative to countertop 6. As shown in FIG. 2, a linear actuator 86 is arranged within base 40 and includes a piston 87 attached to base 68, and a cylinder 88 which is fixed to a cross piece 90. Linear actuator 86 can take various forms known in the art, including hydraulic, pneumatic and electrical actuators. Although not shown, a control unit is preferably provided wherein a toggle switch or the like is engaged to selectively raise or lower a respective carrier frame 63. In FIG. 1, article support and transfer assembly 60*a* is shown in a fully lowered position wherein cover 70 is generally flush with platform 16 and assemblies 60*b* and 60*c* are shown in a raised position.

Based on the above, it should be readily apparent that the article support and transfer assembly of the invention provides a convenient system for transferring numerous articles simultaneously between food storage or preparation areas and eating areas. Although three assemblies 60*a*–60*c* have been shown and described herein, it should be realized that additional, smaller assemblies could be provided, as well as only a single assembly without departing from the invention. Actually, although described with respect to a preferred embodiment of the invention, it should be understood that various changes and/or modifications can be made to the invention without departing from the spirit thereof. For instance, linear actuator 86 could be simply replaced by a mechanical linkage system, or even a damping system wherein carrier frame 63 is biased to the raised position, but wherein carrier frame 63 can be lowered against the biasing force of a spring or the like and retained in the lowered position shown for assembly 60*a* by means of a releasable latch.

It is also possible to integrate any one of the article support and transfer assemblies 60*a*–60*c* as part of an internal dishwasher system for workstation 2. That is, dishwashers including vertically shiftable rack assemblies are fairly old in the art. Therefore, one or more outer dishwashing basins could be arranged beneath central zone 17 within base 40 and each tray 72 could constitute a wire rack of the dishwasher which could be shifted into a respective basin, with cover 70 sealing off the top of the unit. With such an arrangement, any dishes, utensils and the like which require washing after a meal could be loaded adjacent table 49. Thereafter, the respective tray could be centered over zone 17 to permit carrier frame 63 to be lowered for a washing operation. Furthermore, although article support tray 72 has been shown and described incorporated into island 2, it should be readily apparent that the invention is also applicable to other type of through passage arrangements between a kitchen and another area. Finally, it should be recognized that tray 72 can support an abundance of different articles, including simply supporting commonly needed items, such as napkins, condiments, paper towels or the like. Obviously, there is a wide range of uses for the article support and transfer assembly of the invention and the invention is only intended to be limited by the scope of the following claims:

We claim:

1. A kitchen workstation assembly comprising:

a countertop including an elongated work space defined, at least in part, by a first side edge of the countertop, said countertop also including a second side edge which is opposite said first side edge;

at least one of a cooktop and a sink provided in the countertop; and an article support member slidably mounted for movement in opposing directions between a first extended position, wherein the article support member projects above at least a portion of the work space, and an opposing, second extended position, wherein the article support member projects, at least partially, beyond the second side edge of the countertop, and wherein said article support member constitutes a wire rack.

2. The kitchen workstation assembly according to claim 1, wherein the countertop has positioned thereon a platform adjacent the second side edge, said article support member being slidable to a central position between the first and second extended positions, with said central position being arranged above said platform.

3. The kitchen workstation assembly according to claim 2, further comprising: a tabletop supported above the platform.

4. The kitchen workstation assembly according to claim 1, wherein the workstation further includes a table projecting away from the second side edge of the countertop, wherein the article support member extends above the table in the second extended position.

5. The kitchen workstation assembly according to claim 1, wherein the article support member constitutes a dishwasher rack.

6. A kitchen workstation assembly comprising;

a countertop including an elongated work space defined, at least in part, by a first side edge of the countertop, said countertop also including a second side edge which is opposite said first side edge;

at least one of a cooktop and a sink provided in the countertop; and an article support member slidably mounted for movement in opposing directions between a first extended position, wherein the article support member projects above at least a portion of the work space, and an opposing, second extended position, wherein the article support member projects, at least partially, beyond the second side edge of the countertop, wherein said article support member forms part of an article support and transfer assembly, said article support and transfer assembly further including a carrier frame and means for slidably interconnecting the article support member to the carrier frame.

7. The kitchen workstation assembly according to claim 6, wherein the carrier frame and the means for slidably interconnecting include a pair of spaced supports, said article support member being mounted between the supports.

8. The kitchen workstation assembly according to claim 6, wherein the article support member is vertically shiftable between raised and lowered positions relative to the countertop.

9. The kitchen workstation assembly according to claim 8, wherein the carrier frame further includes a cover which defines a substantially planar surface when the article support member is in the lowered position.

10. A kitchen workstation assembly comprising:

a countertop including a work surface;

at least one of a cooktop and a sink provided in the countertop;

a carrier frame movable between raised and lowered positions relative to the countertop; and an article support member slidably attached to the carrier frame for movement between first and second opposing, extended positions, with said article support member projecting, at least partially, off the carrier frame in each of the first and second extended positions.

11. The kitchen workstation assembly according to claim 10, wherein at least a portion of the article support member projects directly above the work surface in the first extended position.

12. The kitchen workstation assembly according to claim 11, wherein the countertop includes a side edge portion, remote from the work surface, said article support member projecting beyond the side edge portion in the second extended position.

13. The kitchen workstation assembly according to claim 12, further comprising: a table projecting away from both the work surface and the side edge of the countertop, said article support member extending above the table when in the second extended position.

14. The kitchen workstation assembly according to claim 10, further comprising: a platform extending above a portion of the countertop, said carrier frame being arranged in a central portion of the platform.

15. The kitchen workstation assembly according to claim 14, further comprising: a tabletop supported above the platform.

16. The kitchen workstation assembly according to claim 10, wherein the carrier frame including a pair of spaced, upstanding supports, said article support member being slidably attached to the upstanding supports.

17. The kitchen workstation assembly according to claim 16, wherein the carrier frame further includes a cover interconnecting the upstanding supports, said cover defining a substantially planar surface that is exposed when the carrier frame is placed in the lowered position.

18. The kitchen workstation assembly according to claim 10, wherein the article support member comprises a wire rack.

19. The kitchen workstation assembly according to claim 10, wherein the article support member constitutes a dishwasher rack.

* * * * *